US006807691B1

(12) United States Patent
Hertz

(10) Patent No.: US 6,807,691 B1
(45) Date of Patent: Oct. 26, 2004

(54) PLUMBING VALVE COVER FOR AVOIDING INTERFERENCE WITH FAUCET HOSE

(76) Inventor: Allen D. Hertz, 12784 Tulipwood Cir., Boca Raton, FL (US) 33428

( * ) Notice: Subject to any disclaimer, the term of this patent is extended or adjusted under 35 U.S.C. 154(b) by 3 days.

(21) Appl. No.: 10/622,226

(22) Filed: Jul. 18, 2003

(51) Int. Cl.[7] ..... A47K 1/04

(52) U.S. Cl. ..... 4/654; 4/661; 137/382; 137/377

(58) Field of Search ..... 4/654, 661, 619; 137/375, 377, 381, 382

(56) References Cited

U.S. PATENT DOCUMENTS 3,915,524 A * 10/1975 Langston ..... 312/204
4,862,528 A * 9/1989 Clarke et al. ..... 4/661
5,363,517 A * 11/1994 Botsolas ..... 4/661
5,675,847 A * 10/1997 Pierre ..... 4/654
D387,144 S * 12/1997 Flaherty ..... D23/308
D390,643 S * 2/1998 Trueb et al. ..... D23/308
D431,288 S * 9/2000 Helmsderfer ..... D23/308

* cited by examiner

*Primary Examiner*—Gregory L. Huson
*Assistant Examiner*—Huyen Le
(74) *Attorney, Agent, or Firm*—Allen D. Hertz

(57) ABSTRACT

A plumbing valve cover is disclosed for use in conjunction with under-sink plumbing to avoid interference with the operation of a flexible spray nozzle hose used in conjunction with a spray nozzle. The plumbing valve cover may be coupled to the under-sink plumbing or cabinet wall. The plumbing valve cover may partially cover the under-sink plumbing and include clearances for multiple plumbing lines which may exit a supply valve. The plumbing valve cover may include markings to aid in sizing the cover to variations in the length of a supply line. The preferred embodiment would be a single piece, injection molded plastic apparatus which includes structural ribs and C-shaped mounting clips which mechanically couple the plumbing valve cover to the supply valve.

20 Claims, 7 Drawing Sheets

PLUMBING VALVE COVER FOR AVOIDING INTERFERENCE WITH FAUCET HOSE

FIELD OF THE INVENTION

This invention relates in general to the field of under-sink plumbing valve covers, and in particular to a removable plumbing valve cover which is placed below and proximate an under-sink supply valve or similar object which may interfere with the operation of a spray nozzle and associated flexible movable hose, which may be used in conjunction with a kitchen sink.

BACKGROUND OF THE INVENTION

Sinks or washbasins may include a spray nozzle or water dispenser which is attached to a flexible hose, where the flexible hose retracts into an opening and is stored freely under the sink. A weight may be attached to the hose to assist in retracting the hose into the opening and improve storage control of the flexible hose under the sink. The hose generally is provided through an opening on the side or rear of the sink or through an opening in the center of a faucet.

Water supply lines enter from the wall, pass through an opening in a cabinet and are coupled to a valve. A supply line exits the valve and connects to a faucet control such that the user can turn the water on and off. It is recognized that there may be hot and cold water lines, as well as multiple inlet lines exiting from each valve for other appliances such as refrigerators or dish washing machines.

The supply line is normally horizontal which may be the optimal orientation for installing the cabinets. The valve generally has an oval shaped handle. The handle is generally larger than the water supply line. The orientation of the plumbing and the handle on the valve creates a scenario that can interfere with the movement of the loose hose. It can be seen that a hose of sufficient length can loop below the horizontal water supply line or lines and, become entrapped. This may preclude the spray nozzle from fully deploying and render the nozzle useless.

Thus, what is necessary is a low cost and efficient apparatus for avoiding the interference between the retractable hose and the plumbing and valves.

SUMMARY OF THE INVENTION

One aspect of the present invention is to provide a low cost apparatus for at least partially shielding under-sink plumbing.

A second aspect of the present invention is the design of the low cost apparatus such that the apparatus will preclude interference from the under-sink plumbing with the retractable hose.

A third aspect of the present invention is the design of the apparatus for easy installation and removal.

A fourth aspect of the present invention is the design of the apparatus such that the apparatus snaps onto a feature of the plumbing.

A fifth aspect of the present invention would be a design that includes a two-piece system which can snap, be screwed together, and the like to fasten around a feature of the plumbing.

A sixth aspect of the present invention is a design such that the knob for the respective valve remains exposed to allow operation without removal of the present invention.

A seventh aspect of the present invention is the inclusion of reference markings, notch, removable feature, and the like to provide for clearances for various supply and inlet lines as well as fitting between the cabinet and the plumbing valves.

A seventh aspect of the present invention is the inclusion of a label or printed identifier used for advertisement or promotional means, such as including the contact information for a respective plumber.

An eighth aspect of the present invention is the ability to manufacture the apparatus using injection molding.

A ninth aspect of the present invention is the inclusion of a slot(s), the slots providing for cable ties as a means to couple the present invention to the under-sink plumbing.

A tenth aspect of the present invention is the inclusion of a means to secure the present invention to at least one of the cabinet or a wall.

An eleventh aspect of the present invention is to fabricate the present invention of a semi-rigid or rigid material.

A twelfth aspect of the present invention is an application or design such to reinforce or increase the rigidity of the present invention along a line of contact of the hose.

BRIEF DESCRIPTION OF THE DRAWINGS

| Nr. | Index |
|---|---|
| 10 | Sink |
| 12 | Cabinet |
| 14 | Faucet |
| 16 | Faucet handle |
| 18 | Spray nozzle |
| 20 | Flexible sprayer hose |
| 22 | Sink Hose Opening |
| 24 | Supply Line Plumbing |
| 26 | Supply line Valve |
| 28 | Supply Line Valve Handle |
| 30 | Inlet line plumbing |
| 32 | "P trap" |
| 34 | Flexible Hose Weight |
| 36 | Cabinet Doors |
| 40 | Plumbing Valve Cover |
| 42 | Plumbing Valve Cover Mount |
| 44 | Supply Line Connector |
| 46 | Valve to Sink Inlet Line Connector |
| 48 | Sizing Indicators |
| 50 | Flexible Hose Motion |
| 52 | Plumbing Clearance |
| 54 | Plumbing Valve Cover Supporting Structure |
| 60 | User Applied Lifting Force |
| 62 | Resultant Force |
| 64 | Normal Force |
| 66 | Tangential Force |
| 70 | Supply Valve Handle Clearance |
| 72 | Wall Mounting Hole |
| 74 | Adjusting Wall Mount Slot |
| 76 | Supporting Ribs |

DETAILED DESCRIPTION OF THE INVENTION

Figure 1:
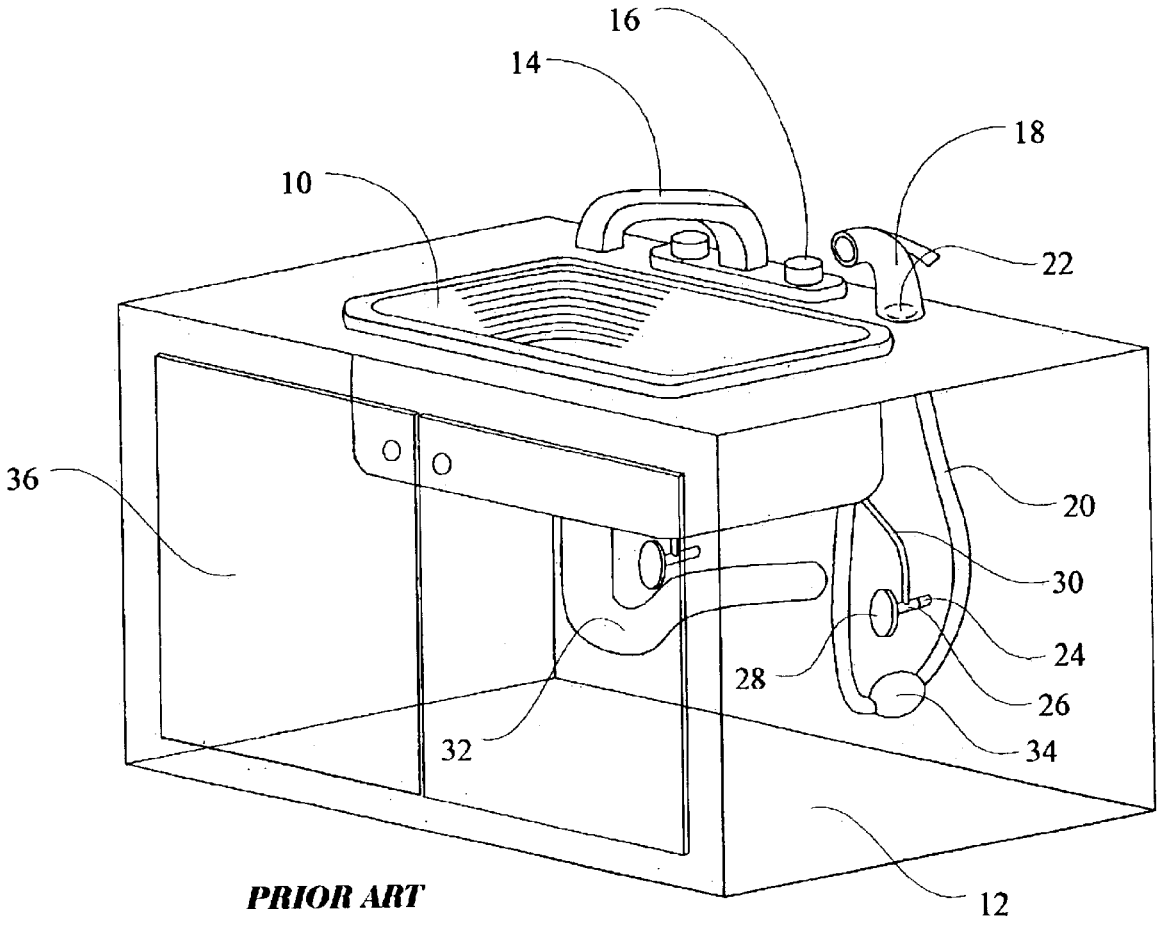
FIG. 1 is an isometric view of a kitchen sink, a supporting cabinet, and respective plumbing.

FIG. 1 illustrates an isometric view of a sink 10 mounted within a cabinet 12 to illustrate the need for the present invention. A faucet 14 and faucet handles 16 are generally mounted through holes located in either the sink 10 or the top of the cabinet 12. A spray nozzle 18 may be accessed through a flexible hose opening 22 located adjacent to the faucet 14 or through a flexible hose opening in the faucet 14 (not shown in that configuration). The spray nozzle 18 is coupled to an exit end of a flexible hose 20 with an inlet end of the flexible hose 20 coupled to the plumbing (not shown) to provide water (not shown) to the spray nozzle 18. There are many methods known to couple the hose to each fixture. The water is provided to the system through supply line plumbing 24, a supply line valve 26 and inlet line plumbing 30, normally one for cold water and a second for hot water. The supply line valve 26 may be designed in various configurations. The supply line valve 26 is illustrated in an angled configuration, where the supply valve handle 28 would be located in front of the plumbing. Alternatively, supply line valves 26 may be configured as a through valve where the supply valve handle 28 is located on the top of the valve. The supply line valve 26 may be configured to include one or more connections for outputs to provide for inlet lines 30 to the sink or other appliances. The water drains through a P-Trap 32 which has a first end of the P-Trap 32 is coupled to a drain (not shown) located at the bottom of the bowl of the sink 10 and a second end of the P-Trap 32 is coupled to a sewage line (not shown) generally located at the back of the cabinet.

It can be recognized from the illustration that the under-sink plumbing comprising supply line plumbing 24, supply line valve(s) 26, and supply line valve handle(s) 28 would interfere with the flexible hose 20 when the flexible hose 20 is pulled through the flexible hose opening 22 by the user.

The figure is provided to illustrate a general arrangement of plumbing located under a sink, where the plumbing includes a spray nozzle 18 coupled to the flexible hose 20.

Figure 2:
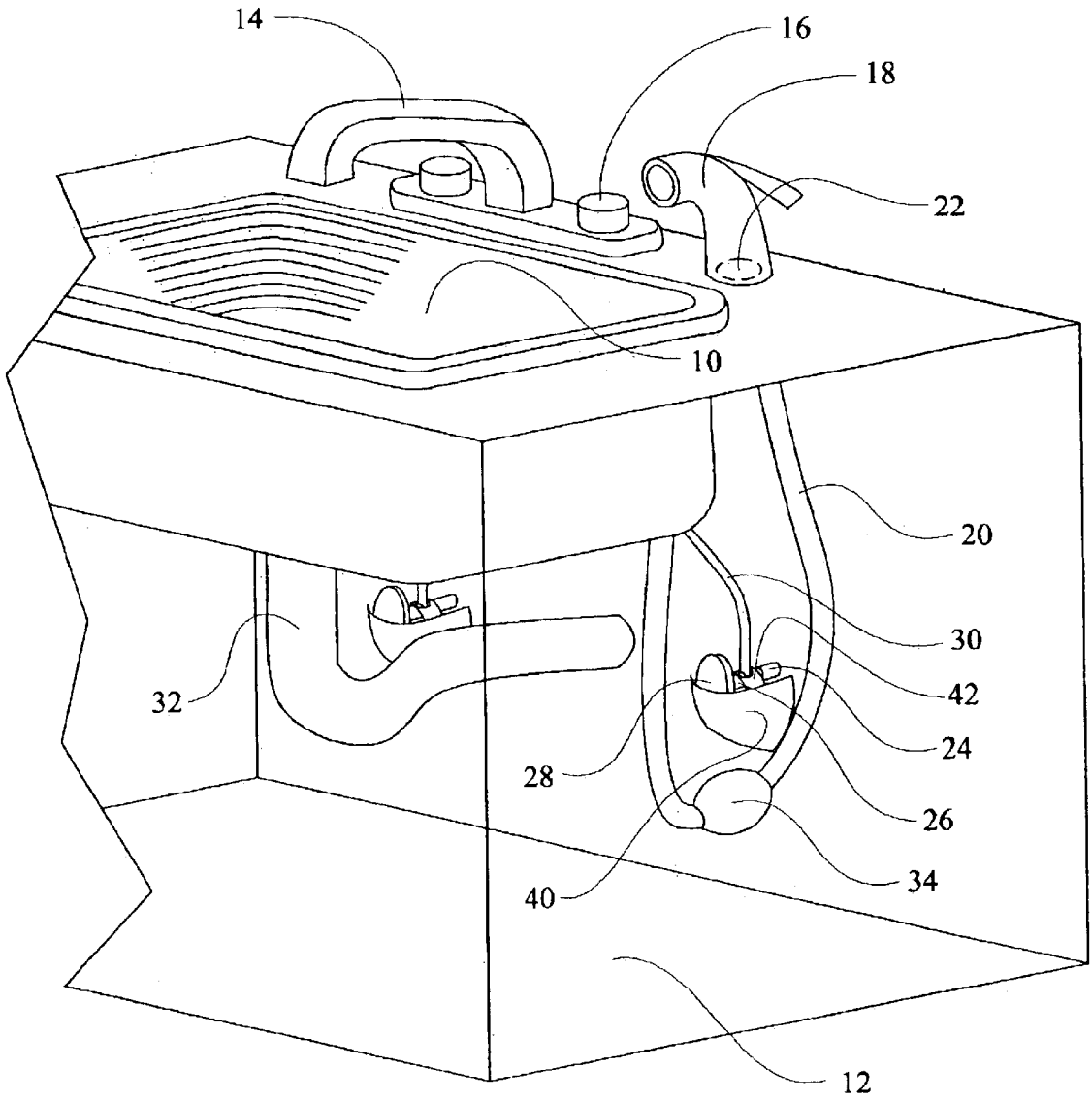
FIG. 2 is an isometric view of a plumbing valve shield installed in accordance with the preferred embodiment of the present invention.

FIG. 2 is an enlarged section of the isometric view of FIG. 1 including the present invention installed according to a preferred embodiment. In accordance with the preferred embodiment of the present invention, a plumbing valve cover 40 is mechanically coupled to the supply valve 26 by a plumbing valve cover mount 42. The preferred method to install the plumbing valve cover 40 would be to include a "C-shaped" snap mount which mechanically couples the plumbing valve cover 40 to the supply valve 26. The "C-shaped" mount may be included within an injection molding manufacturing process to minimize manufacturing costs. It can be recognized that there are many other methods of coupling the plumbing valve cover 40 such as a pipe clamp around the supply valve 26, secured by a snap feature, screws, and the line.; a first half that encompasses a portion of the when fastened to a second half, or of any known methods of coupling an object to a pipe or valve. Alternatively, the plumbing valve cover 40 may be mounted to the back of the cabinet or respective wall. It should be recognized that the method of installation should not limit the present invention.

The function of the plumbing valve cover is exhibited by the illustration whereby the design of the plumbing valve cover 40 allows at least one of the flexible hose 20 and flexible hose weight 34 to ride against the plumbing valve cover 40 thus avoiding interference between the lower service loop of the flexible hose 20 and the supply valve 26, supply valve handle 28, and other such plumbing. This will be described in more detail below. In the present state, as the flexible hose 20 is pulled through the flexible hose opening 22, the plumbing would interfere with the lower service loop created by the geometry of the flexible hose 20. The inclusion of the present invention provides an apparatus whereby when the lower service loop created in the flexible hose 20 rides against the bottom of the plumbing valve cover 40; the flexible hose 20 would not be caught in the plumbing. The bottom of the plumbing valve cover 40 is designed such that as the flexible hose 20 is pulled upwards through the flexible hose opening 22, the lower service loop rides along the bottom of the plumbing valve cover 40 and moves in front of the supply valve 26, supply valve handle 28, and associated plumbing thus avoiding any interference.

Figure 3:
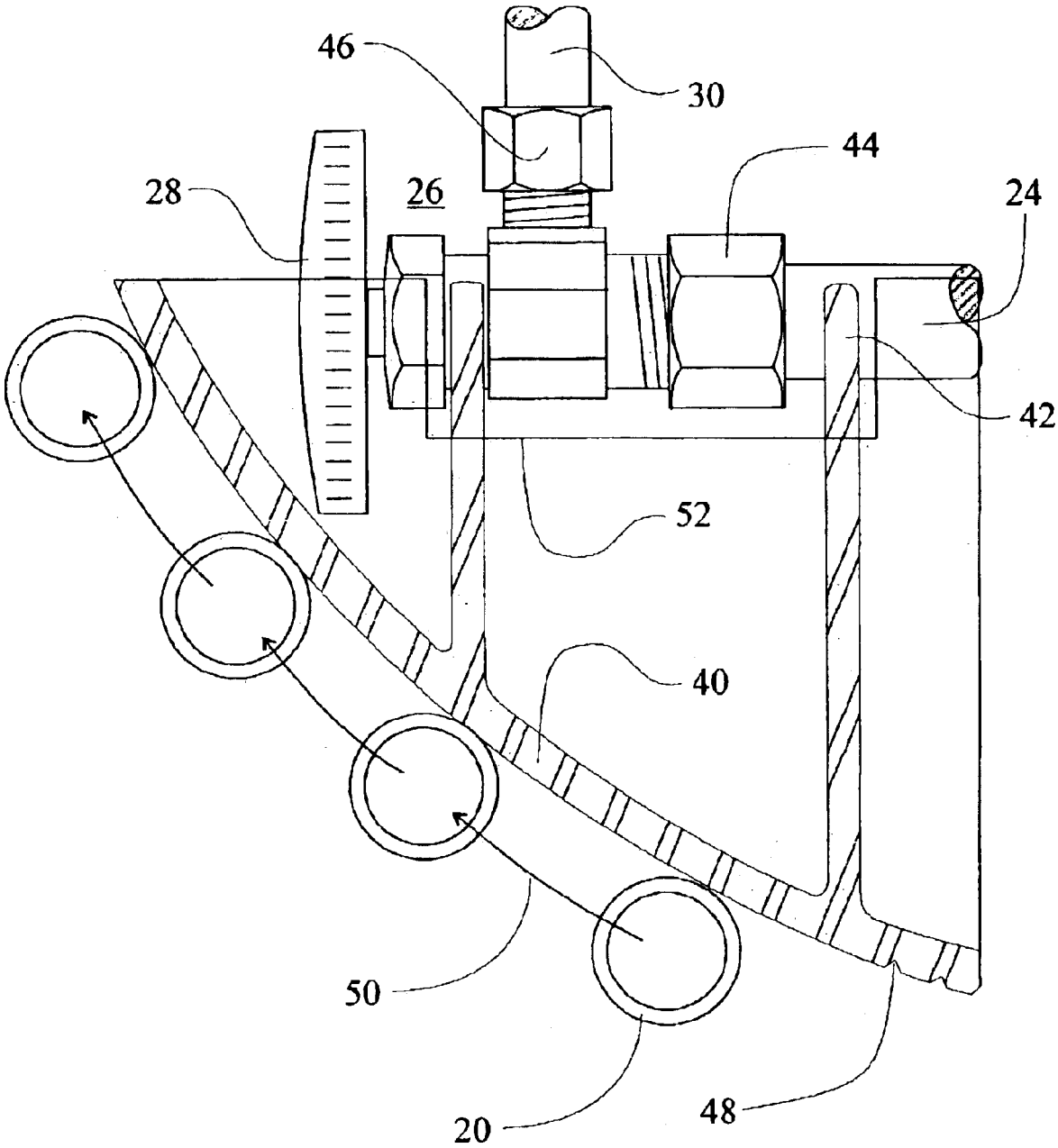
FIG. 3 is a cross sectional side view of the plumbing valve shield.

FIG. 3 is a cross-sectional view of the plumbing valve cover 40 further illustrating the resulting motion of the flexible hose 20 respective to the plumbing valve cover 40 as the flexible hose 20 is lifted through the flexible hose opening 22. The supply valve assembly 26 includes a supply line connector 44 for coupling the supply valve 26 to the supply line plumbing 24, a valve to sink inlet line connector 46 for coupling the supply valve 26 to the inlet line plumbing 30 and the supply line valve handle 28. The shape of the supply valve 26 provides ample locations for mechanically coupling the plumbing valve cover 40, using any of known mechanical coupling methods such as a "C-shaped" clamp 42 which would partially wrap around the supply valve 26. The plumbing valve cover 40 would be shaped in a manner to provide for the flexible hose 20 to move forward 50 when being raised through the flexible hose opening 22 by the user. The plumbing valve cover may include markings such as a molded in groove 48 to indicate areas to trim the plumbing valve cover 40 to fit for varying distances between the supply valve 26 and the back of the cabinet (not shown). It is recognized that there are many other means of providing a reference to indicate areas to trim the plumbing valve cover 40 to fit for varying distances between the supply valve 26 and the back of the cabinet (not shown). The plumbing valve cover 40 may further include a plumbing clearance section 52 for additional plumbing which may exit the sides (not shown) of the supply valve 26. The clearance may be included in the design as shown or of removable sections.

Figure 4:
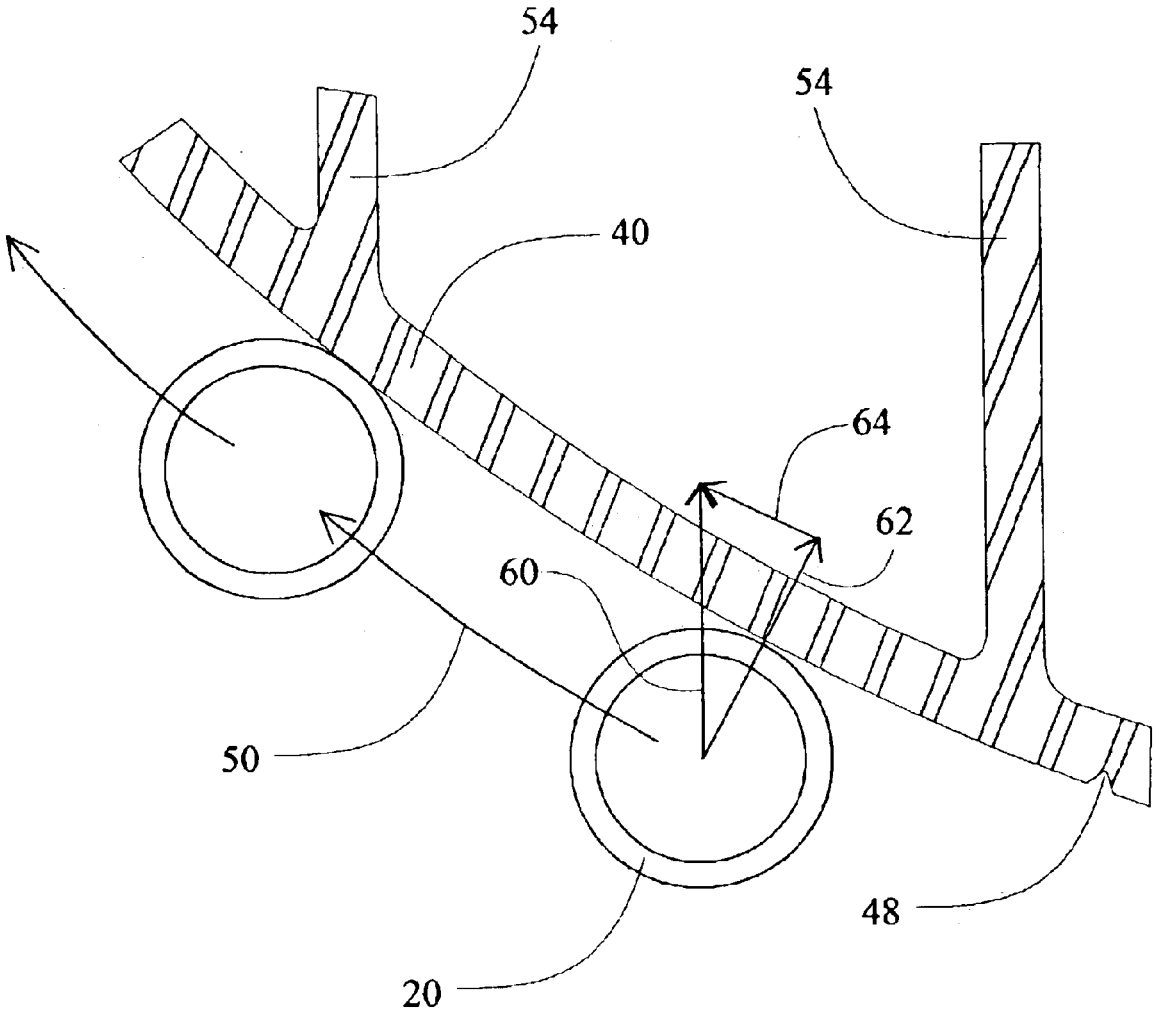
FIG. 4 is an enlarged sectional side view of FIG. 3 including a free body diagram further illustrating the forces provided which move a flexible hose around the plumbing valve.

FIG. 4 is a cross sectional view of the present invention as in FIG. 3 including a free body diagram illustrating the forces which move the flexible hose 20 to avoid interfering with the plumbing. When the user lifts the flexible hose 20 through the flexible hose opening 22, the hose introduces a user applied force 60. The user applied force 60 is composed of a normal force 62 and a tangential force 64. The tangential force 64 moves the flexible hose 20 in a manner to avoid interference with the plumbing.

Figure 5:
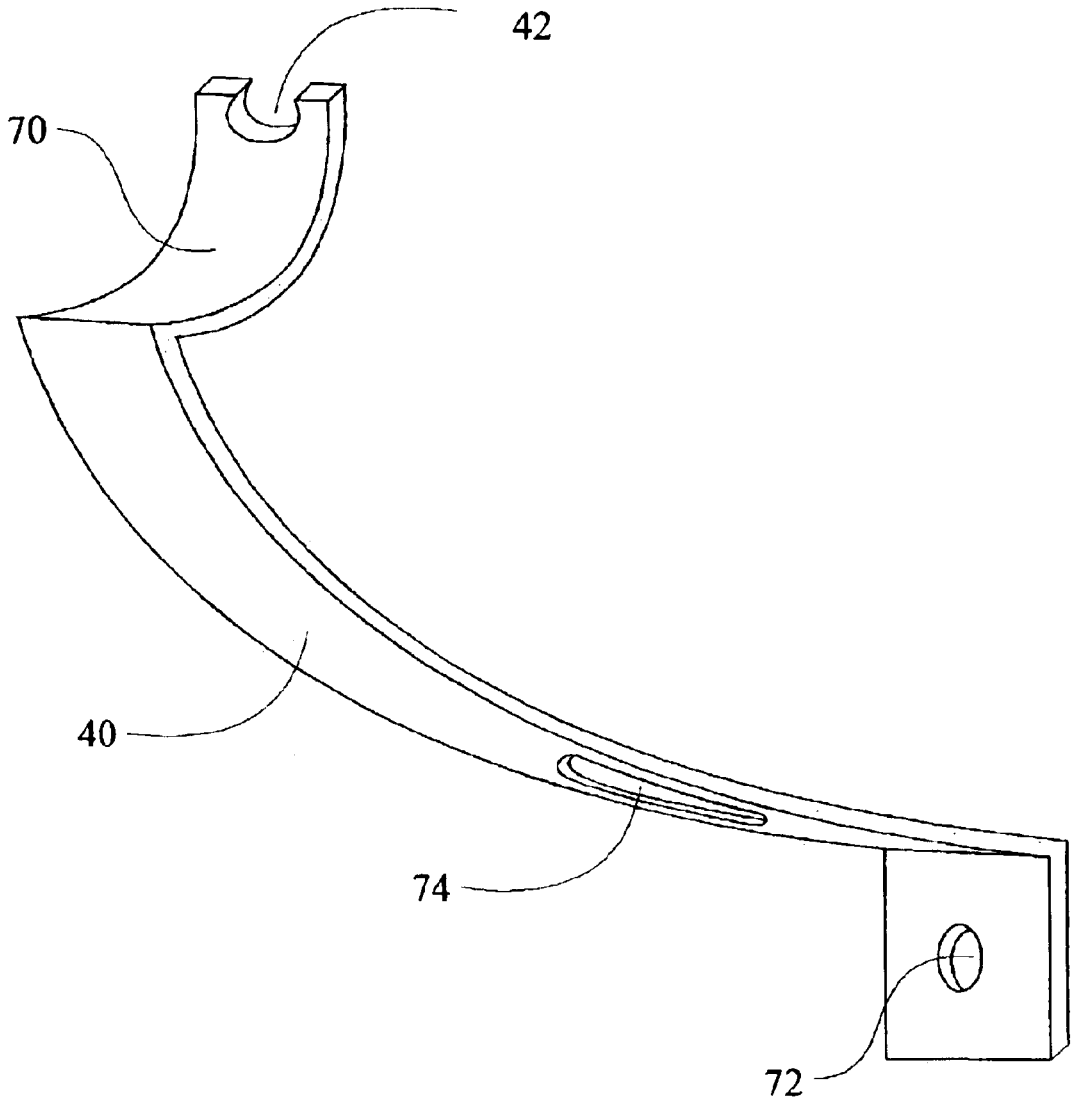
FIG. 5 is an isometric view of a strip style valve shield in accordance with an alternate embodiment of the present invention.

FIG. 5 is an isometric view of an alternate embodiment of the present invention. The described alternate embodiment includes the plumbing valve cover 40 which avoids interference with the flexible hose 20 (not shown in this figure), a valve handle clearance 70, a wall mount 72, and a adjusting mount slot 74. The embodiment illustrated would mechanically couple a first end of the plumbing valve cover 40 to the supply valve 26 (not shown) proximate the supply valve handle 28 (not shown) and mechanically couple a second end of the plumbing valve cover 40 to the wall (not shown) using the wall mount 72. The plumbing valve cover 40 may be manufactured from stamped metal molded plastic, or any other means to provide the desired shape. It would be preferred that the material allows for flexibility to provide a means to adjust the size of the overall apparatus. It can be recognized that there are many other methods of adjusting the size of the plumbing valve cover 40 whereby the means of sizing the plumbing valve cover 40 should not limit the spirit or intent of the present invention.

Figure 6:
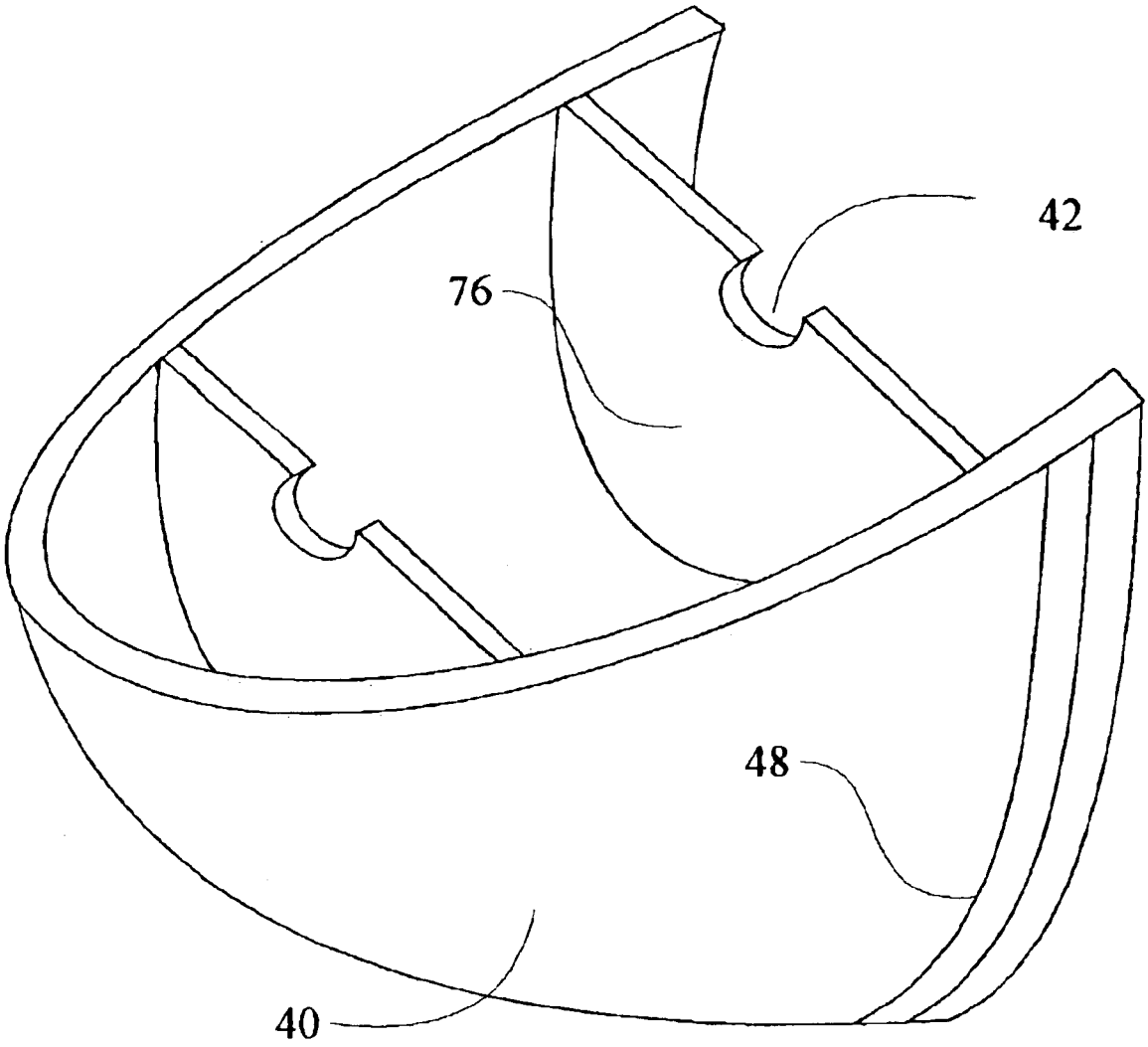
FIG. 6 is an isometric view of a plumbing valve shield that partially covers the supply valve in accordance with an alternative embodiment of the present.

FIG. 6 is an isometric view representative of a second embodiment of the present invention. The described embodiment includes the plumbing valve cover 40 which avoids interference with the flexible hose 20 (not shown in this figure) and a means of mounting the plumbing valve cover 40. The illustration includes C-shaped clips 42 to mechanically couple the plumbing valve cover 40 to the supply valve 26. The illustration further includes reinforcing member(s) 76 used to add strength to the body of the plumbing valve cover 40. This particular embodiment would be preferably manufactured of pliable molded plastic to provide for the C-shaped clamps 42. Additionally, the figure illustrates sizing indicators 48 for trimming the plumbing valve cover 40 to provide for variations, in the length of the supply line 24 (not shown).

Figure 7:
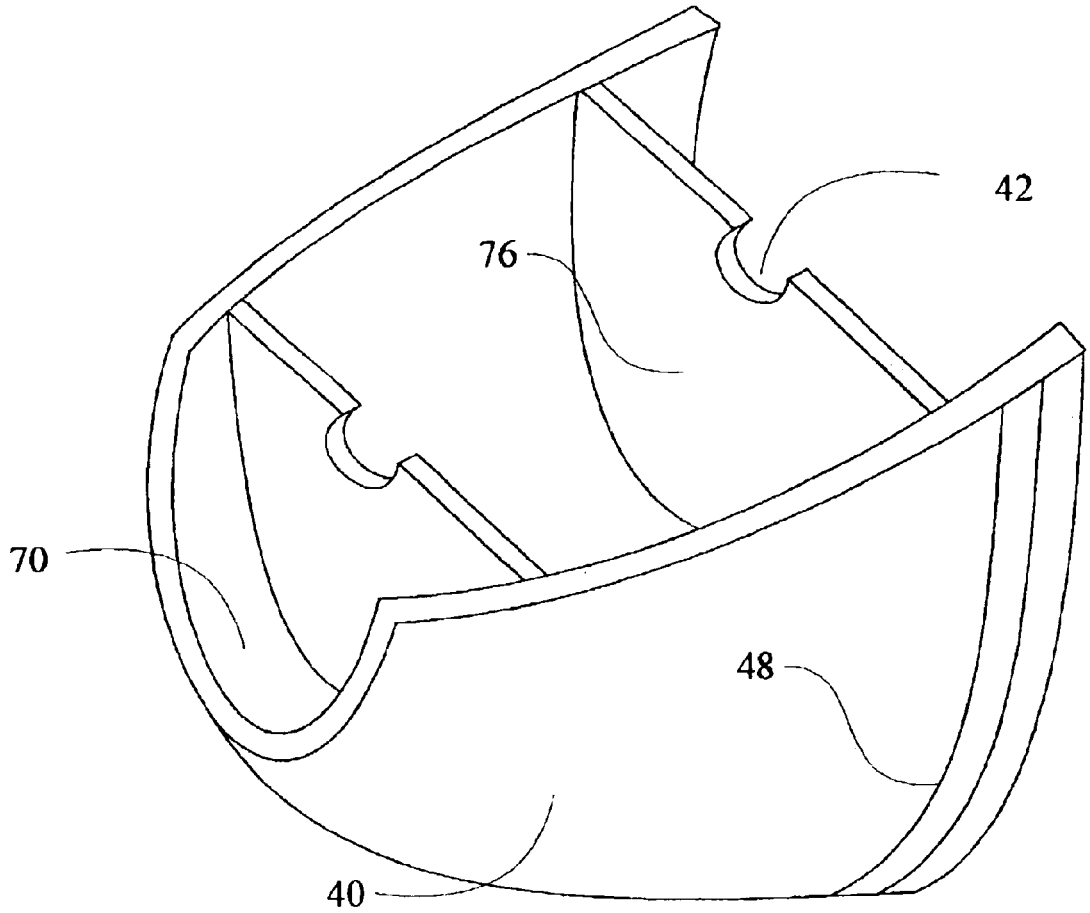
FIG. 7 is an isometric view of a valve shield with a clearance for a plumbing valve cover handle.

FIG. 7 is an isometric view representative of a third embodiment of the present invention, similar to the second embodiment of FIG. 6, with the addition of a valve handle clearance 70. It can be recognized that the valve handle clearance 70 can be defined or referenced by reference markings similar to the length indicators 48.

It can be recognized that the variations of design or features for achieving the aspects of the present invention should not limit the spirit, scope or intentions of the present invention. It can be recognized that advertisements may be applied via labels, printed onto the surface, embossed on the surface, molded into the material, and the like.

The plumbing valve cover can be manufactured using injection molding processes metal forming processes, machining processes (although they are normally cost prohibitive), and the like. The materials can be of rubber, plastic, resins, metal, or any other cost effective material.

What is claimed is:

1. A plumbing valve cover apparatus for avoiding interference between under-sink plumbing and a flexible spray hose for a spray nozzle, whereby the apparatus comprises:

an apparatus designed in a shape such to be positioned at least proximate the underside of a sink supply line valve, whereby the section of the apparatus that is positioned to the underside of the sink supply line valve causes the flexible spray hose to reposition towards the front of the sink supply line valve as the flexible spray hose is pulled upwards; and a member for securing said plumbing valve cover to at least one of:

a) the sink supply line valve, b) a supply line piping, c) an the inlet line plumbing, d) a sink cabinet, and e) a wall.

2. The plumbing valve cover of claim 1, wherein the plumbing valve cover at least partially encompasses the under-sink plumbing.

3. The plumbing valve cover of claim 1, wherein the plumbing valve cover provides access to a supply valve handle.

4. The plumbing valve cover of claim 1, wherein the plumbing valve cover further comprises:

a coupling mechanism which mechanically couples the valve cover to at least one of:

a) the sink supply line valve, b) a supply line piping, c) an the inlet line plumbing.

5. The plumbing valve cover of claim 4, wherein the coupling mechanism is molded into a reinforcing member.

6. The plumbing valve cover of claim 5, wherein the "C-shaped" coupling section is molded into the plumbing valve cover.

7. The plumbing valve cover of claim 4, wherein the coupling mechanism is a "C-shaped" coupling section.

8. The plumbing valve cover of claim 1, wherein the plumbing valve cover is constructed using at least one of the following production processes:

a) injection molding, and b) metal cut and forming.

9. The plumbing valve cover of claim 1, wherein the plumbing valve cover further comprises a reference mark for trimming sections to assist in the installation process of the plumbing valve cover.

10. A plumbing valve cover apparatus for avoiding interference between under-sink plumbing and a flexible spray hose for a spray nozzle, whereby the apparatus comprises:

a plumbing valve cover designed whereby the cross-sectional shape being one quarter of an ellipse, whereby a section of the plumbing valve cover that is positioned underside of a sink supply line valve causes the flexible spray hose to reposition towards the front of the sink supply line valve as the flexible spray hose is pulled upwards; and a member for securing said plumbing valve cover to at least one of:

f) the sink supply line valve, g) a supply line piping, h) an the inlet line plumbing, i) a sink cabinet, and j) a wall.

11. The plumbing valve cover of claim 10, wherein the plumbing valve cover at least partially encompasses the under-sink plumbing.

12. The plumbing valve cover of claim 10, wherein the plumbing valve cover provides access to a supply valve handle.

13. The plumbing valve cover of claim 10, wherein the plumbing valve cover further comprises:

a coupling mechanism which mechanically couples the valve cover to at least one of:

d) the sink supply line valve, e) a supply line piping, f) an the inlet line plumbing.

14. The plumbing valve cover of claim 13, wherein the coupling mechanism is molded into a reinforcing member.

15. The plumbing valve cover of claim 14, wherein the "C-shaped" coupling section is molded into the plumbing valve cover.

16. The plumbing valve cover of claim 13, wherein the coupling mechanism is a "C-shaped" coupling section.

17. The plumbing valve cover of claim 10, wherein the plumbing valve cover further comprises a reference mark for trimming sections to assist in the installation process of the plumbing valve cover.

18. A method of positioning a lower service loop of a spray nozzle hose around under-sink plumbing, the method comprising the steps positioning a plumbing valve cover proximate the under-sink plumbing, pulling the spray nozzle hose upwards through a spray nozzle hose, and sliding the spray nozzle hose along the lower section of the plumbing valve cover, whereby the sliding motion causes the spray nozzle hose to move away from a supply line thus clearing the under-sink plumbing.

19. The method of claim 18, the method further comprising the step of coupling the plumbing valve cover to at least one of:

a) the sink supply line valve, b) a supply line piping, and c) an the inlet line plumbing.

20. The method of claim 18, the method further comprising the step of coupling the plumbing valve cover to at least one of a) a sink cabinet, and b) a wall.

* * * * *